US006196882B1

(12) United States Patent
Sato et al.

(10) Patent No.: US 6,196,882 B1
(45) Date of Patent: Mar. 6, 2001

(54) ELECTRIC CONNECTION BOX

(75) Inventors: Hidetoshi Sato; Koji Miyakoshi, both of Gotenba (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/251,913

(22) Filed: Feb. 19, 1999

(30) Foreign Application Priority Data

Feb. 20, 1998 (JP) ..... 10-039291

(51) Int. Cl.[7] ..... H01R 13/502

(52) U.S. Cl. ..... 439/701; 174/50; 174/59; 200/297; 220/4.02; 361/730

(58) Field of Search ..... 174/48, 50, 57, 174/58, 60, 66, 59; 439/701; 361/819, 730, 724; 220/241, 3.8, 4.02, 3.92, 3.94; 200/297

(56) References Cited

U.S. PATENT DOCUMENTS 4,954,102 * 9/1990 Ozaki et al. ..... 439/535
5,162,069 * 11/1992 Morris ..... 156/363
5,454,733 * 10/1995 Watanabe et al. ..... 439/54.1
5,510,957 * 4/1996 Takagi ..... 361/814
5,523,908 * 6/1996 Shinohara ..... 360/96.6
5,615,960 * 4/1997 Mori et al. ..... 400/613
5,757,578 * 5/1998 Shimoyama et al. ..... 360/96.5
5,876,255 * 3/1999 Oda et al. ..... 439/752

FOREIGN PATENT DOCUMENTS 61-134629 8/1986 (JP) .

* cited by examiner

*Primary Examiner*—Kristine Kincaid
*Assistant Examiner*—Dhiro R Patel
(74) *Attorney, Agent, or Firm*—Morgan, Lewis & Bockius LLP

(57) ABSTRACT

An electric connection box in which cassettes of different kinds can be attached to side walls of one casing, and by doing so, the casing can have a design for common use, and also the degree of freedom of arrangement of the cassettes can be enhanced. In electric connection box, a casing (1) includes at least one casing-side retaining portion (5); at least one cassette (10; 11) is attachable to the casing (1), the cassette (10; 11) includes an attaching-side portion having a cassette-side retaining portion (16; 19); and at least two pairs of casing-side fitting guide portions (4, 14) are formed in a projected manner on a side surface of the casing (1). When the cassette (10; 11) is attached to the casing (1), the attaching-side portion is guided by one of the two pairs of casing-side fitting guide portions (4, 14), and the cassette-side retaining portion (16; 19) is engaged with the casing-side retaining portion (5).

8 Claims, 9 Drawing Sheets

( PLAN VIEW )

FIG. 1A
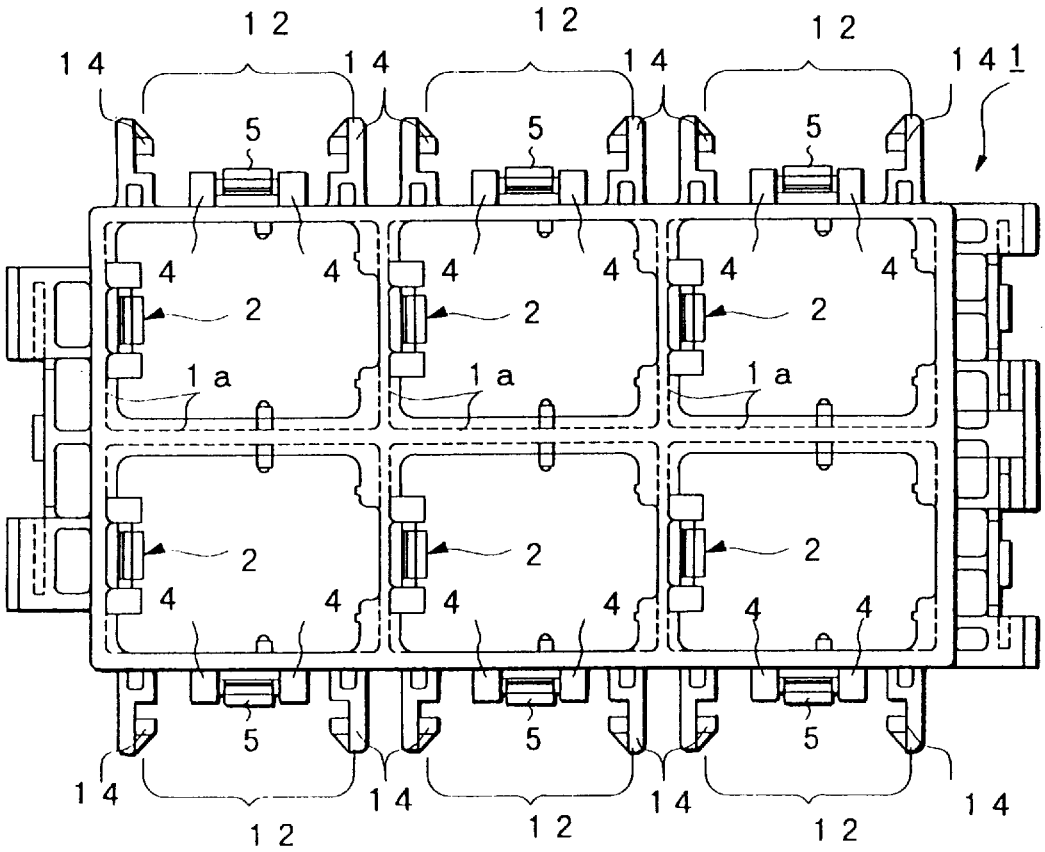
( PLAN VIEW )
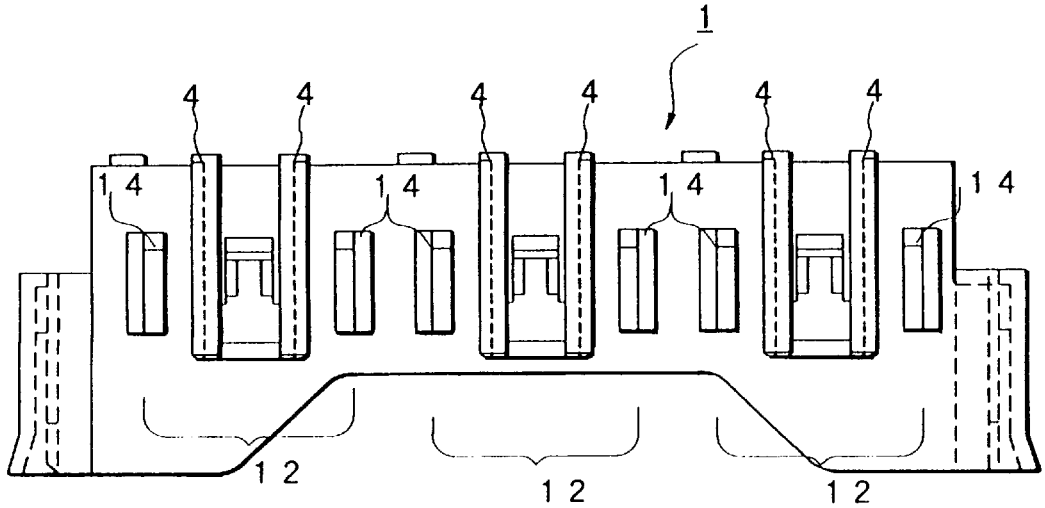
( SIDE – ELEVATIONAL VIEW )
FIG. 1B

FIG. 2A
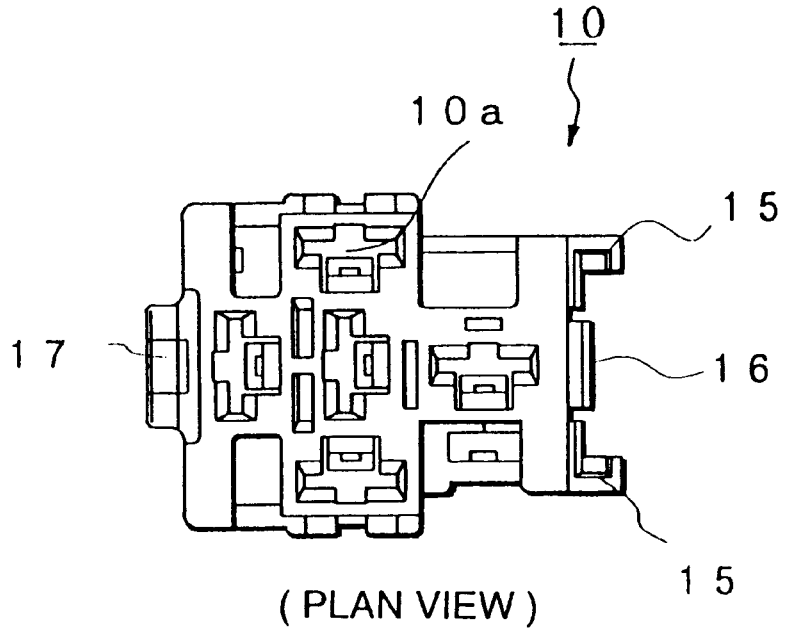
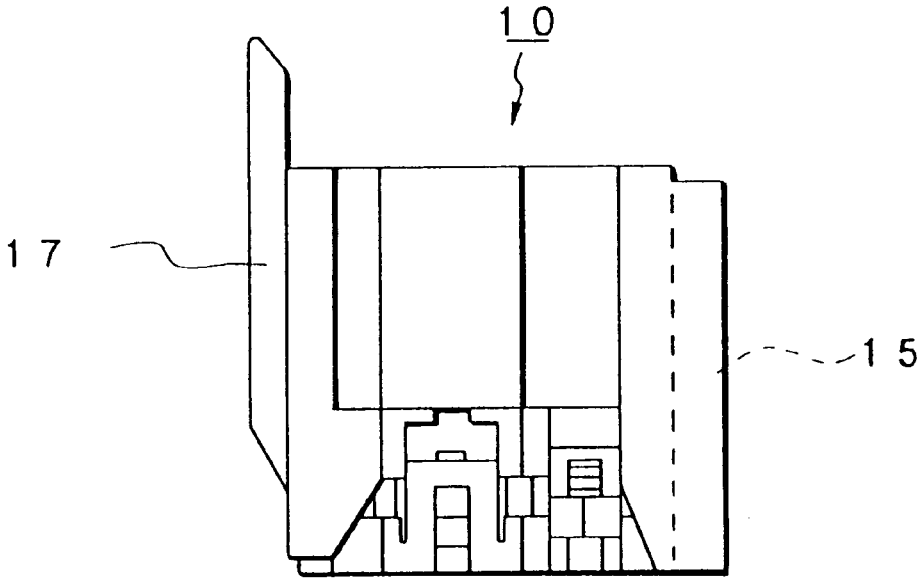
( SIDE – ELEVATIONAL VIEW )
FIG. 2B

FIG. 3A
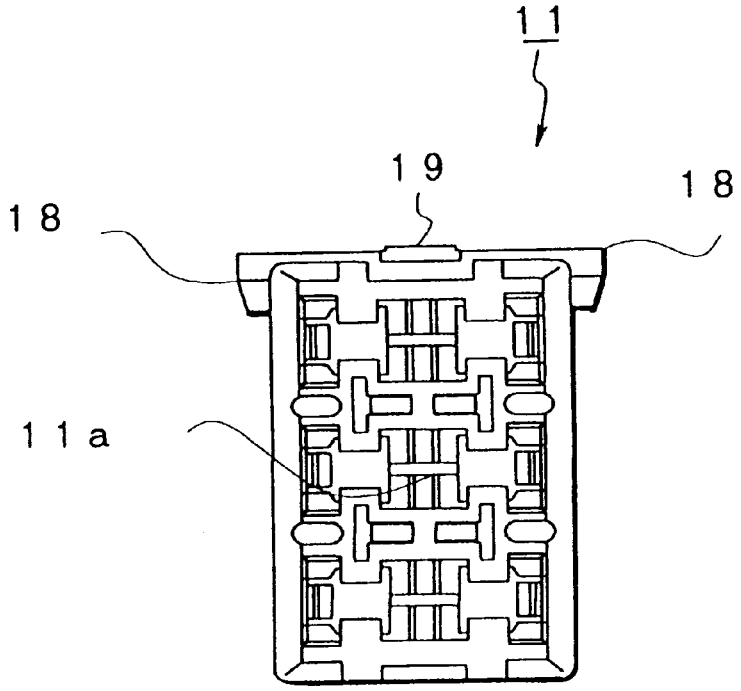
( PLAN VIEW )
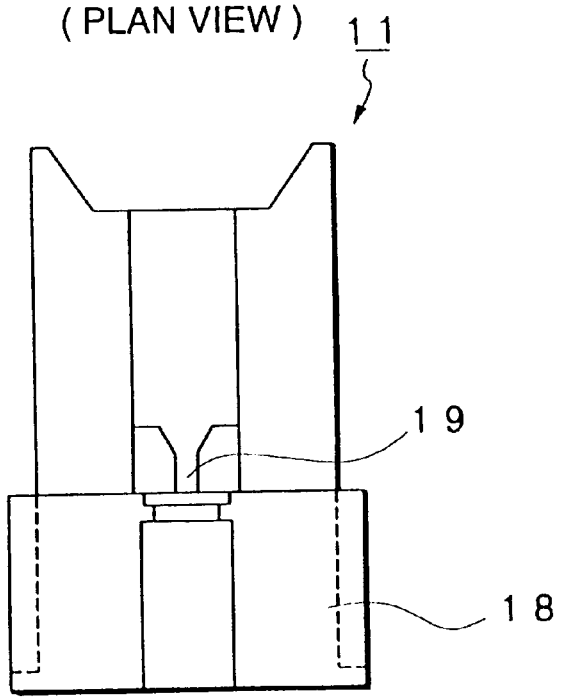
( SIDE – ELEVATIONAL VIEW )
FIG. 3B

FIG. 9A
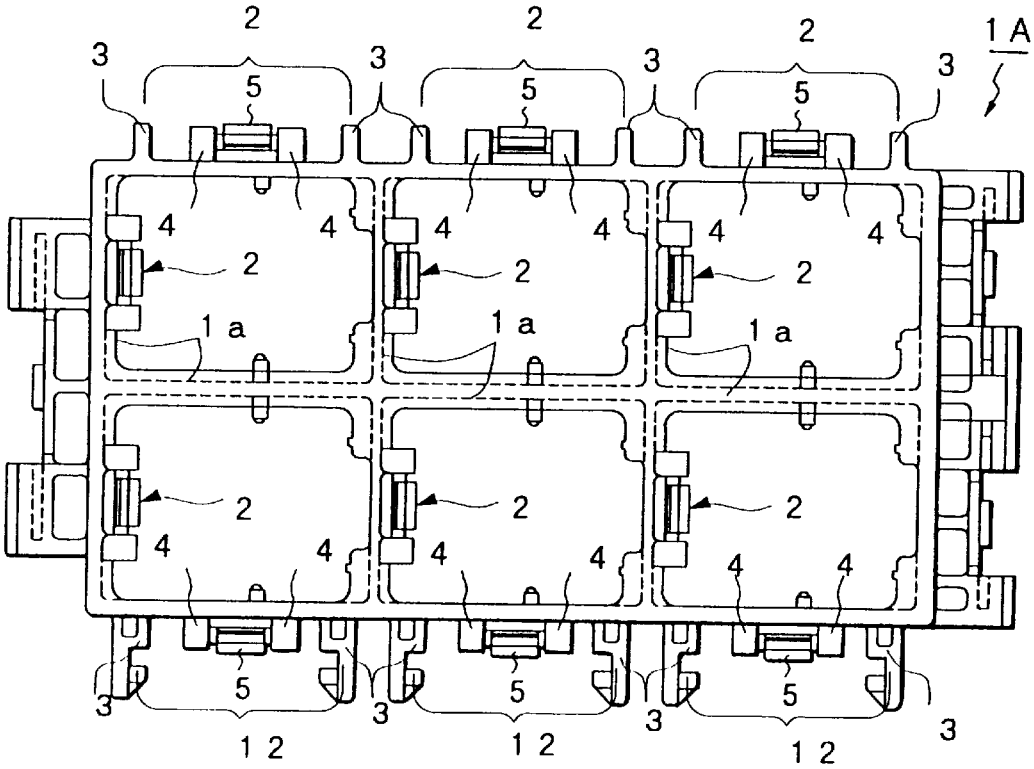
( PLAN VIEW )
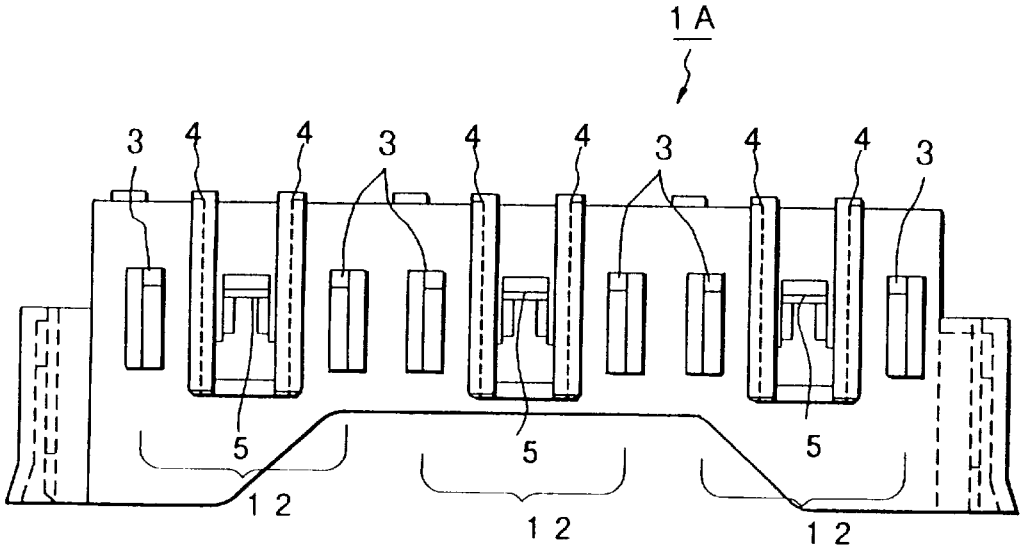
( SIDE – ELEVATIONAL VIEW )
FIG. 9B

FIG. 10A
*PRIOR ART*
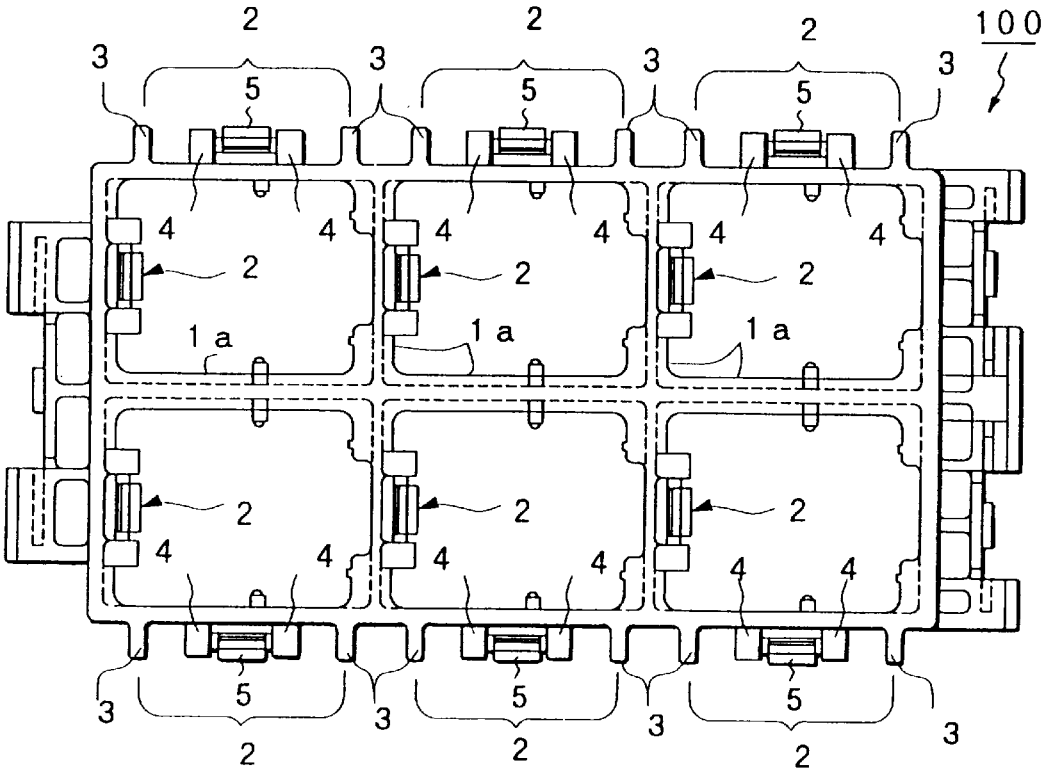
( PLAN VIEW )
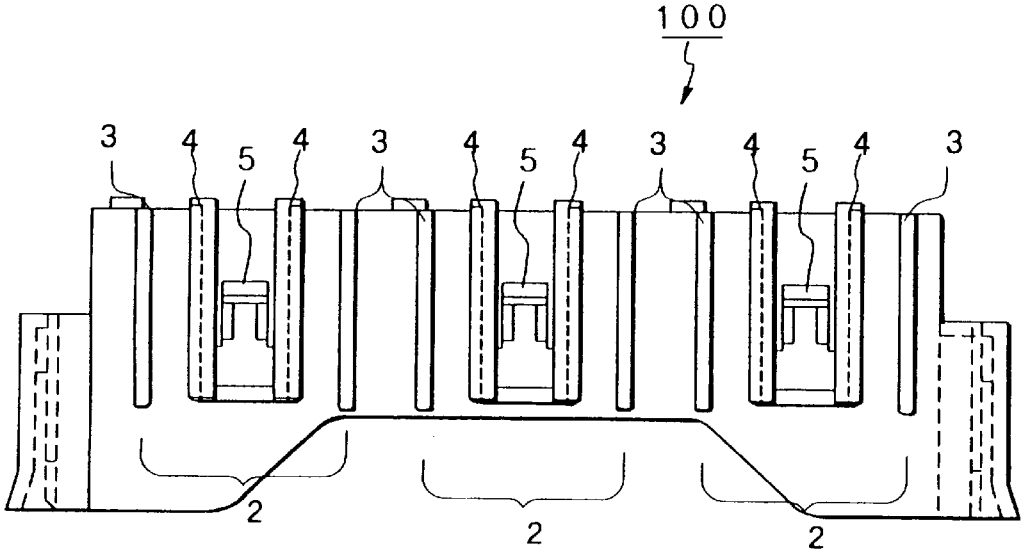
( SIDE – ELEVATIONAL VIEW )
FIG. 10B

ELECTRIC CONNECTION BOX

BACKGROUND OF THE INVENTION

1. Field of the Invention

The present invention relates to an electric connection box in which cassette-like electric parts can be attached in a module-like manner to side surfaces of a casing. More particularly, the present invention relates to an electric connection box in which cassettes of different sizes and shapes can be fixed to common positions.

The present application is based on Japanese Patent Application No. Hei. 10-39291, which is incorporated herein by reference.

2. Description of the Related Art

Generally, in a recent automobile provided with various electric equipments, there is used an electric connection box by which a plurality of electric circuits are connected together in a concentrated manner so as to transmit signals between the electric equipments.

An electric connection box, shown in FIG. 10, comprises a box-like casing 100 whose interior is divided in longitudinal and transverse directions into a plurality of sections by partition walls 1*a*, and a plurality of relay cassette fitting portions 2 formed respectively on inner surfaces of the sections, divided by the partition walls 1*a*, and opposite outer side surfaces of the casing. Each of the cassette fitting portions 2 has a cassette bracket construction for fixedly holding a module-like relay cassette.

In many cases, the number and kind of electric equipments to be mounted varies depending on the kind of a car and even on the grade of the car of the same kind, and therefore because of this variable factor, the casing 100, which is the essential part, is used in common for the various kinds of cars. The required number of cassettes are attached to the casing in accordance with the electric equipments to be used, and by doing so, the required electric equipments are mounted on the car in accordance with the kind and grade of the car. In the illustrated electric connection box, up to 6 cassettes can be attached to the outer side surfaces of the casing if necessary.

Each of the cassette fitting portions 2, formed at the outer side surfaces of the casing 100, includes a pair of vertically-extending partition bars 3 (to be disposed respectively on opposite sides of the cassette) formed on the outer side surface of the casing 100, a pair of fitting guides 4 and 4 which are formed between the pair of partition bars 3 in parallel relation thereto, and have fitting grooves, respectively, for guiding the sliding movement of the cassette, and a lock pawl 5 which is formed between the pair of fitting guides 4 and 4 so as to retain the inserted cassette against withdrawal.

For attaching the cassette, the front end portion of the cassette is inserted into the cassette fitting portion from the lower side of the casing, and then is moved upward along the fitting guides, and when the cassette slides over the lock pawl 5, the cassette is fixed by the lock pawl against withdrawal.

In the casing 100 of the above construction, however, only one kind of cassettes (for example, relay cassettes) can be attached thereto, and cassettes of different sizes and kinds can not be attached to the casing.

And besides, the kinds of cassettes, varied in number depending on the kind and grade of the car, include fuse cassettes in addition to the above relay cassettes, and the fuse cassette and the relay cassette are slightly different in size from each other, and therefore it is necessary to prepare another casing having fitting portions for respectively holding the fuse cassettes. Therefore, there have been encountered drawbacks that the degree of freedom of wiring connection between the casings, as well as the degree of freedom of arrangement of the cassettes, is low, and that the size of the electric connection box is increased.

SUMMARY OF THE INVENTION

With the above problems in view, it is an object of this invention to provide an electric connection box in which cassettes of different kinds can be attached to side walls of one casing, and by doing so, the casing can have a design for common use, and also the degree of freedom of arrangement of the cassettes can be enhanced.

To achieve the above object, according to the first aspect of the present invention, there is provided an electric connection box which comprises: a casing (1) including at least one casing-side retaining portion (5); at least one cassette (10; 11) attachable to the casing (1), the cassette (10; 11) including an attaching-side portion having a cassette-side retaining portion (16; 19); and at least two pairs of casing-side fitting guide portions (4, 14) formed in a projected manner on a side surface of the casing (1), wherein, when the cassette (10; 11) is attached to the casing (1), the attaching-side portion is guided by one of the two pairs of casing-side fitting guide portions (4, 14), and the cassette-side retaining portion (16; 19) is engaged with the casing-side retaining portion (5).

According to the second aspect of the present invention, it is preferable that the cassette-side retaining portion (16; 19) is formed on a side surface of the cassette (10; 11).

According to the third aspect of the present invention, it is preferable that the casing-side retaining portion (5) is formed midway between each pair of the casing-side fitting guide portions (4, 14).

According to the fourth aspect of the present invention, it is preferable that the electric connection box further comprises a pair of cassette-side fitting guide portions (15; 18) formed on the attaching-side portion of the cassette (10; 11), the cassette-side fitting guide portions (15; 18) being guided by one of the two pairs of casing-side fitting guide portions (4, 14) when the cassette (10; 11) is attached to the casing (1).

According to the fifth aspect of the present invention, it is preferable that, when the cassette (10) having a first pair (15) of the cassette-side fitting guide portions (15; 18) is attached to the casing (1), the first pair (15) of the cassette-side fitting guide portions (15; 18) is guided by a first pair (4) of the casing-side fitting guide portions (4, 14).

According to the sixth aspect of the present invention, it is preferable that, when the cassette (11) having a second pair (18) of the cassette-side fitting guide portions (15; 18) is attached to the casing (1), the second pair (18) of the cassette-side fitting guide portions (15; 18) is guided by a second pair (14) of the casing-side fitting guide portions (4, 14).

According to the seventh aspect of the present invention, it is preferable that a distance between the first pair (4) of the casing-side fitting guide portions (4, 14) corresponds to a width of the first pair (15) of the cassette-side fitting guide portions (15; 18).

According to the eighth aspect of the present invention, it is preferable that a distance between the second pair (14) of the casing-side fitting guide portions (4, 14) corresponds to a width of the second pair (18) of the cassette-side fitting guide portions (15; 18).

Therefore, in the electric connection box of the above construction, any one of different kinds of cassettes, which are different in size from each other, can be attached to the casing, using the casing-side fitting guide portions of the corresponding cassette fitting portion on the outer or inner side surface of the casing, and when the attaching operation is completed, the cassette-side retaining portion is engaged with the casing-side retaining portion, thereby preventing the withdrawal of the attached cassette. Therefore, the casing can be used in common for a plurality of kinds of cassettes, and also the degree of freedom of arrangement of the cassettes can be enhanced. Furthermore, the cassette is attached to the casing while guiding the cassette-side fitting guide portions by the casing-side fitting guide portions, and therefore the attaching operation can be effected more positively and easily.

BRIEF DESCRIPTION OF THE DRAWINGS

FIGS. 1A and 1B show a plan view and a side-elevational view of a casing of one preferred embodiment of an electric connection box of the invention;

FIGS. 2A and 2B show a plan view and a side-elevational view of a relay cassette to be attached to the casing of FIG. 1;

FIGS. 3A and 3B show a plan view and a front-elevational view of a fuse cassette to be attached to the casing of FIG. 1;

FIGS. 9A and 8B show a plan view and a side-elevational view of a casing of another preferred embodiment of an electric connection box of the invention; and FIGS. 10A and 10B show a plan view and a side-elevational view, showing a casing of an electric connection box.

DETAILED DESCRIPTION OF THE PREFERRED EMBODIMENT

Figure 5:
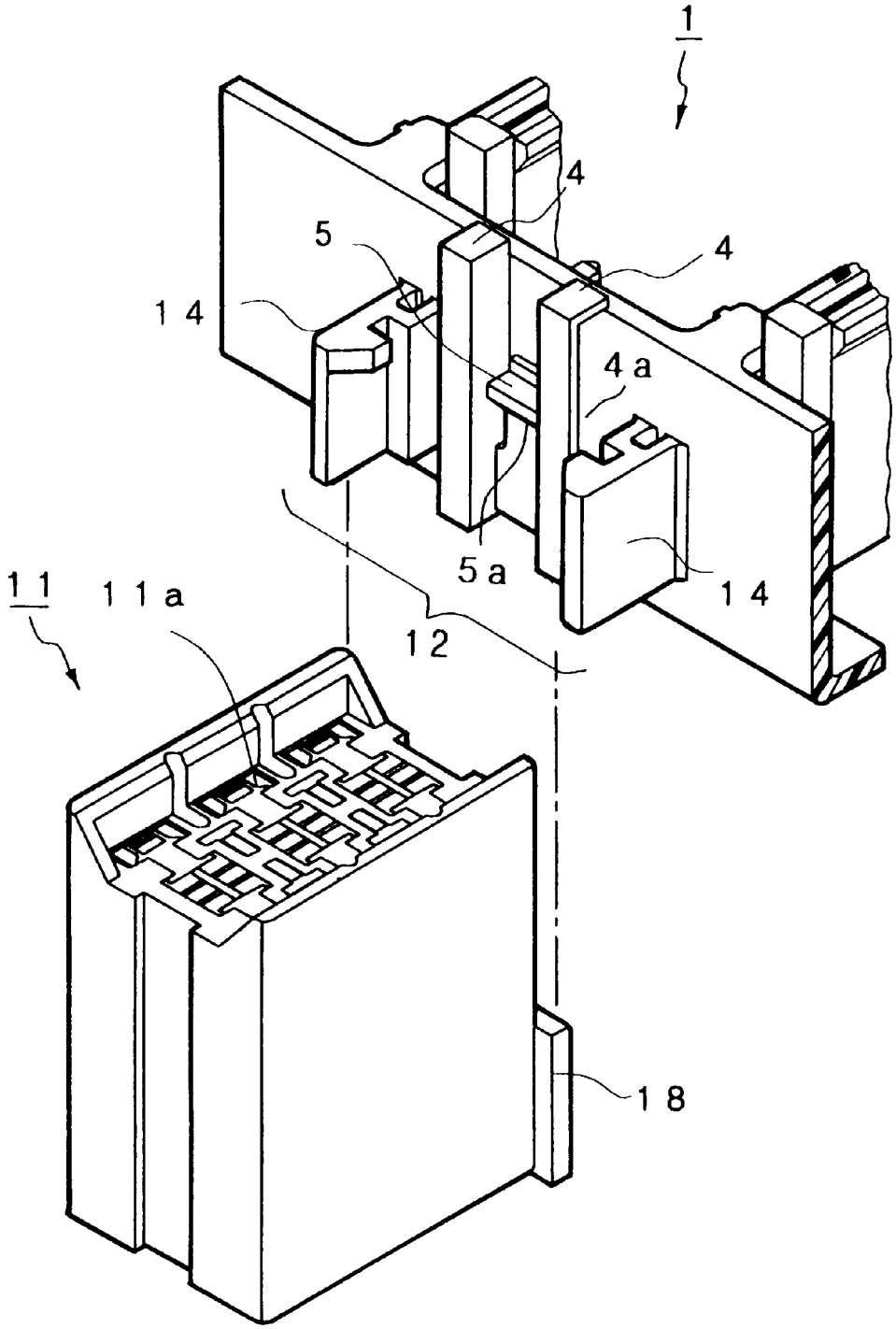
FIG. 5 is an exploded, perspective view showing the relation of mounting between the joint box and the fuse cassette.
Figure 6:
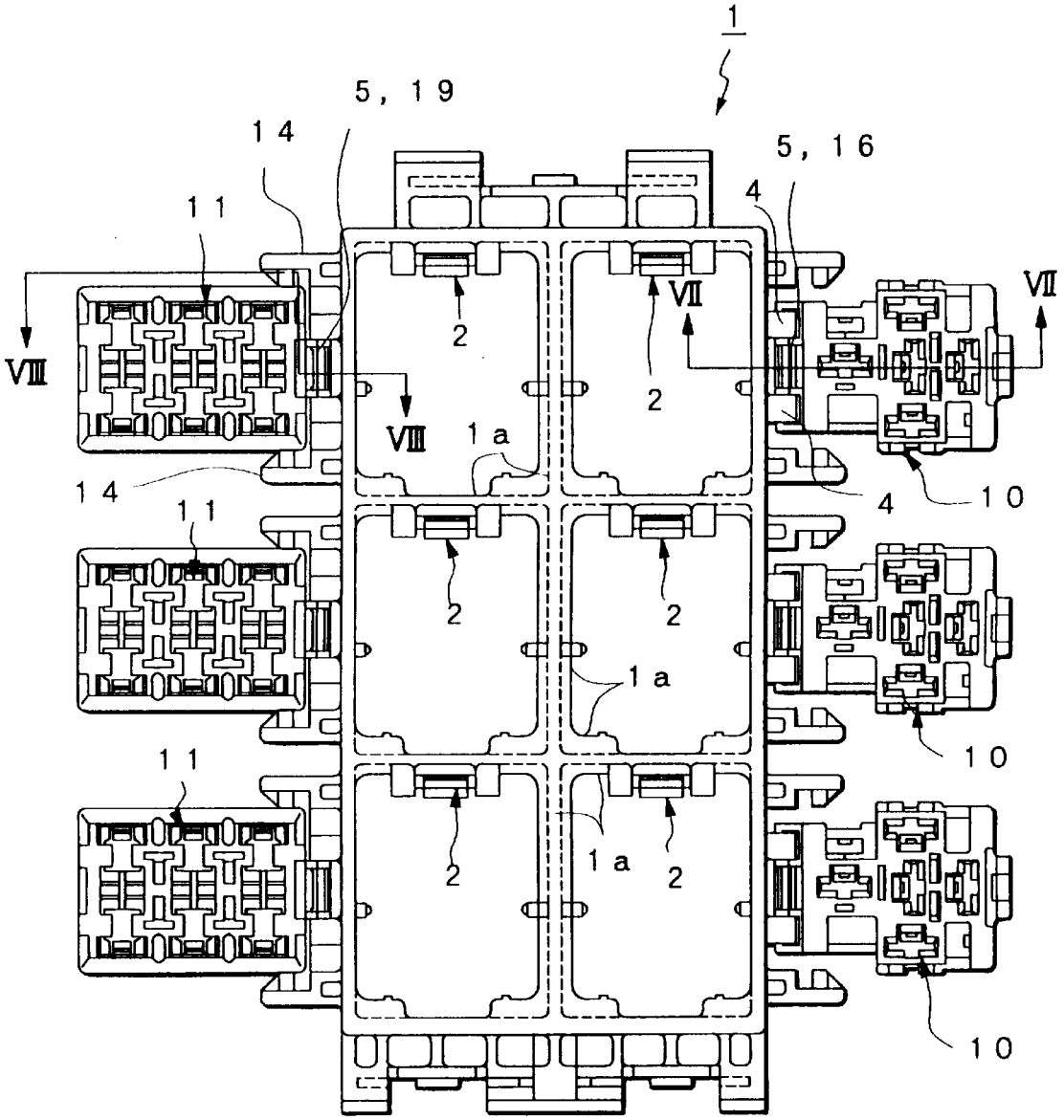
FIG. 6 is a plan view of the casing of FIG. 1 to which the relay cassettes and the fuse cassette are attached.
Figure 7:
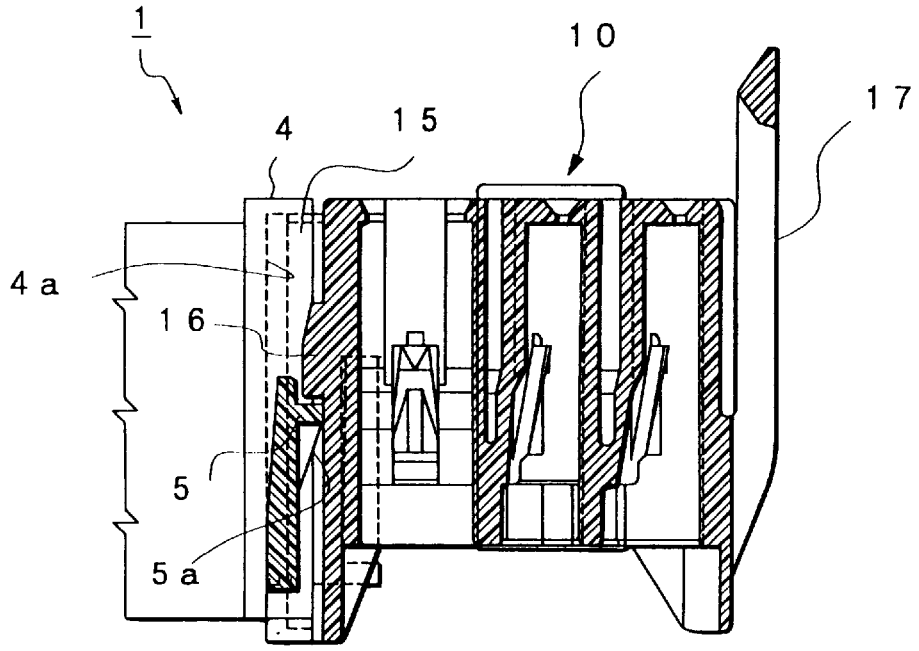
FIG. 7 is a cross-sectional view taken along the line VII—VII of FIG. 6.
Figure 8:
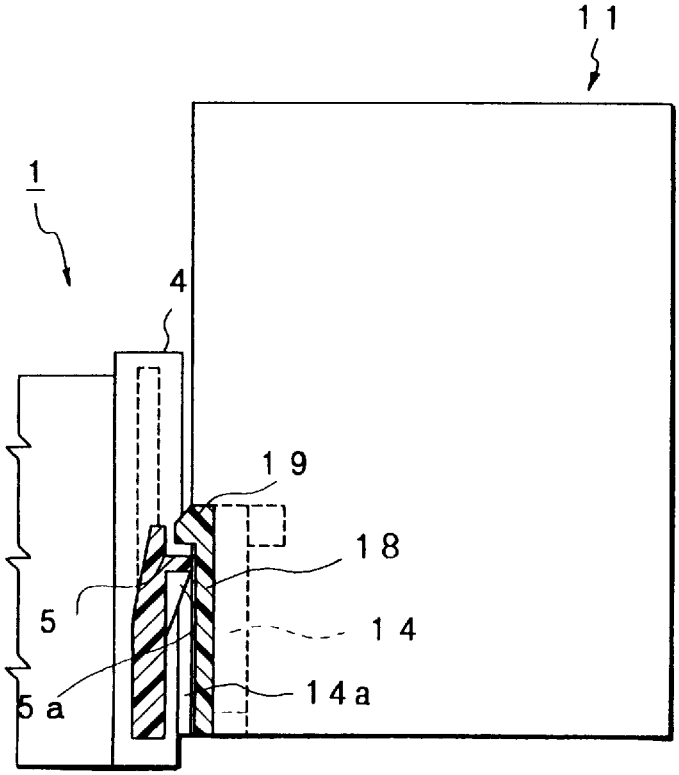
FIG. 8 is a cross-sectional view taken along the line VIII—VIII of FIG. 6.

One preferred embodiment of an electric connection box of the present invention will now be described with reference to FIGS. 1 to 8. Those portions identical to those of the electric connection box discussed in the background section will be designated by identical reference numerals, respectively, and detailed explanation thereof will be omitted. FIG. 1 shows a plan view and a side-elevational view of a joint box constituting one preferred embodiment of the electric connection box of the invention, FIG. 2 shows a plan view and a side-elevational view of a relay cassette to be attached to the joint box of FIG. 1, FIG. 3 shows a plan view and a front-elevational view of a fuse cassette to be attached to the joint box of FIG. 1, FIG. 4 is an exploded, perspective view showing the relation of mounting between the joint box of FIG. 1 and the relay cassette, FIG. 5 is an exploded, perspective view showing the relation of mounting between the joint box of FIG. 1 and the fuse cassette, FIG. 6 is a plan view of the joint box of FIG. 1 in which the relay cassettes are fixed to one side wall of the joint box while the fuse cassette are fixed to the other side wall, FIG. 7 is a cross-sectional view taken along the line VII—VII of FIG. 6, and FIG. 8 is a cross-sectional view taken along the line VIII—VIII of FIG. 6.

As shown in FIG. 1, the electric connection box of this embodiment comprises a box-shaped casing 1 whose interior is divided in longitudinal and transverse directions into a plurality of sections by partition walls 1*a*, and relay cassette fitting portions 2 are formed on inner surfaces of the casing 1. Common cassette fitting portions 12 each capable of holding both the relay cassette 10 (see FIG. 2) and the fuse cassette 11 (see FIG. 3) are formed on opposite outer surfaces (outer walls) of the casing 1. The common cassette fitting portion 12 includes a pair of casing-side fitting guide portions 4 and 4 (for the relay cassette) which have the same construction to those of the relay cassette fitting portion 2, and the fitting guide portions 4 and 4 have fitting grooves 4*a* (see FIG. 7), respectively, which extend in an upward-downward direction, and a lock pawl (casing-side retaining portion) 5 is formed between the casing-side fitting guide portions 4 and 4.

A pair of casing-side fitting guide portions 14 and 14 for the fuse cassette are formed in opposed relation to outer surfaces of each pair of casing-side fitting guide portions 4 and 4, and project outwardly beyond the fitting guide portions 4 and 4. An upper end portion of each fitting guide portion 14 is formed into a hook-shape. The distance between the pair of casing-side fitting portions 14 and 14 corresponds to the width of the fuse cassette 11.

Figure 4:
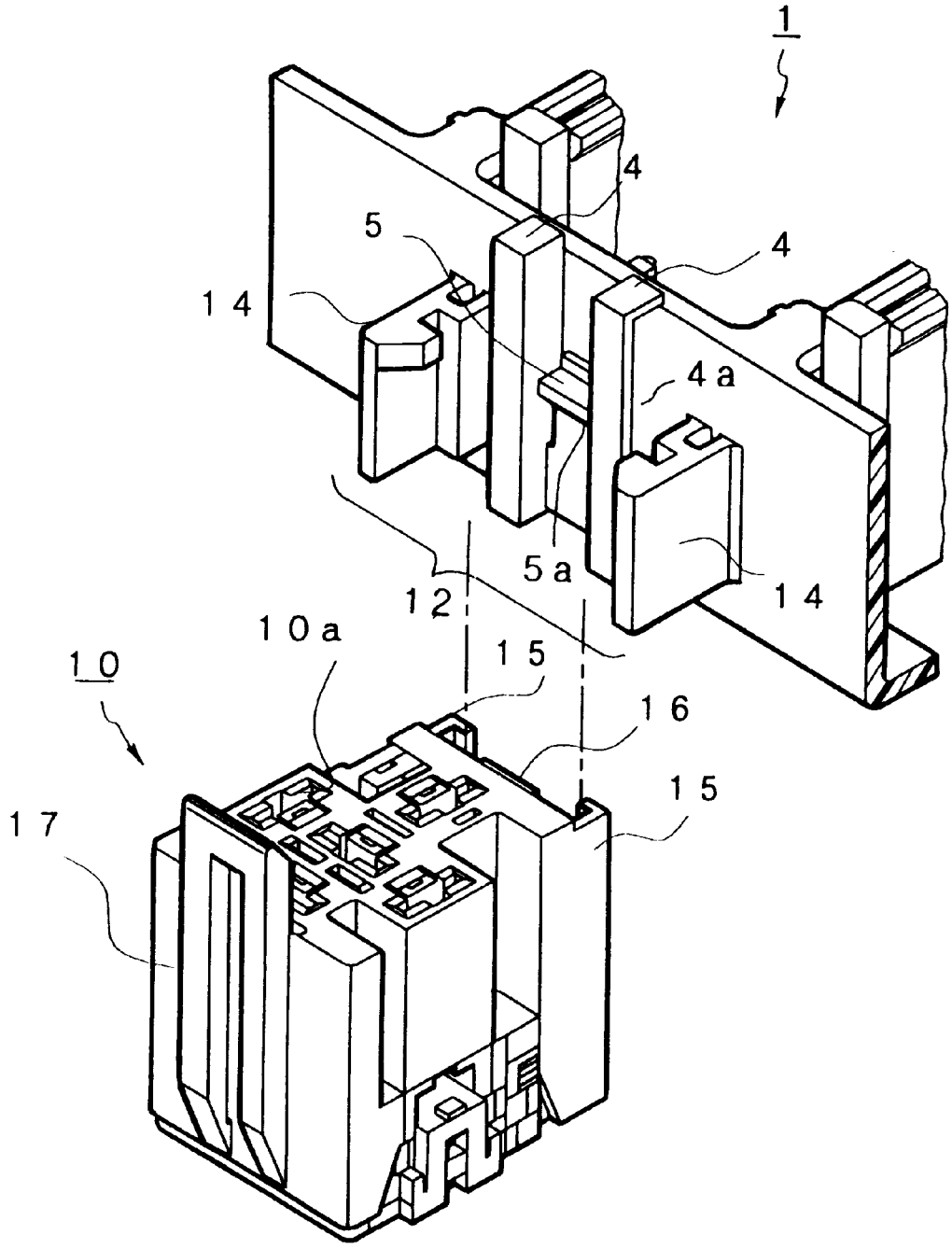
FIG. 4 is an exploded, perspective view showing the relation of mounting between the casing of FIG. 1 and the relay cassette of FIG. 4.

As shown in FIGS. 2 and 4, the relay cassette 10 comprises a rectangular block-like body having relay-inserting holes 10*a* formed in an upper surface thereof, and this cassette 10 has a pair of cassette-side fitting guide portions 15 and 15 of an L-shaped cross-section formed respectively at opposite side portions of that side (face) of the cassette 10 to be mounted on the casing 1. The pair of cassette-side fitting guide portions 15 and 15 can be inserted respectively into the casing-side fitting guide portions 4 and 4 for the relay cassette. A retaining projection (cassette-side retaining portion) 16 for engagement with the lock pawl 5 is formed between the pair of cassette-side fitting guide portions 15 and 15. A manipulating portion 17 for detaching the relay cassette 10 is formed on that side (face) of the relay cassette 10 facing away from the cassette-side fitting guide portions 15.

As shown in FIGS. 3 and 5, the fuse cassette 11 comprises a rectangular block-like body having a plurality of fuse-inserting holes lla formed in an upper surface thereof, this block-like body being larger in size than that of the relay cassette 10. A pair of cassette-side fitting guide portions 18 and 18 are formed respectively at opposite side portions of that side (face) of the fuse cassette 11 to be mounted on the casing 1, and the pair of fitting guide portions 18 and 18 can be inserted respectively into the pair of casing-side fitting guide portions 14 and 14 for the fuse cassette. A retaining projection (cassette-side retaining portion) 19 for engagement with the lock pawl 5 is provided midway between the cassette-side fitting guide portions 18.

The lock pawl 5 of the common cassette fitting portion 12 can be used in common for the cassettes 10 and 11, and the cassette attaching operation is effected using the casing-side fitting guide portions 4 for the relay cassette or the casing-side fitting guide portions 14 for the fuse cassette. The casing-side fitting guide portions 14, formed on the casing 1, much project outwardly beyond the casing-side fitting guide portions 4 so that the fuse cassette 11 of a larger size can be properly attached to the casing without interference with the fitting guide portions 4.

As shown in FIG. 6, the relay cassettes 10 are attached to one of the opposite side walls of the casing 1 whereas the fuse cassettes 11 are attached to the other side wall. For attaching the relay cassette 10, the relay cassette is inserted into the cassette fitting portion from the lower side of the casing 1, and therefore cassette-side fitting guide portions 15 are engaged respectively with the casing-side fitting guide portions 4 for the relay cassette.

As shown in FIG. 7, the cassette-side fitting guide portions 15 are moved upward respectively along the fitting grooves 4*a* formed respectively in the casing-side fitting guide portions 4 for the relay cassette. During this upward movement, the retaining projection 16 abuts against a slanting portion 5*a* of the lock pawl 5 to elastically deform the lock pawl 5, and when the upper ends of the cassette-side fitting guide portions 15 abut against the upper ends of the fitting grooves 4*a*, respectively, the lock pawl 5 is engaged with the lower end of the retaining projection 16, thus completing the attaching operation.

For attaching the fuse cassette 11, the cassette-side fitting guide portions 18 are fitted respectively into guide grooves 14*a*, formed respectively in the casing-side fitting guide portions 14 for the fuse cassette, as shown in FIG. 8, and are moved upward, and this upward movement is limited when each fitting guide portion 18 reaches the upper end of the corresponding guide groove 14*a*. At this time, the lock pawl 5 is engaged with the retaining projection 19, thus completing the attaching operation.

As described above, in the electric connection box of this embodiment, each of the cassette fitting portions 12 includes the plurality of pairs of casing-side fitting guide portions 4 and 14 which are formed in a projected manner on the outer side surface of the casing 1, and respectively guide the attaching-side portions of the corresponding cassettes 10 and 11 in the upward and downward directions, and the lock pawl 5 which is common to the cassettes 10 and 11, and is formed midway between each pair of casing-side fitting guide portions so as to be engaged with the retaining projections 16 and 19 formed on one side surfaces of the cassettes 10 and 11. The distance between each pair of casing-side fitting guide portions 4, 14 corresponds to the width of the corresponding cassette 10, 11.

Therefore, either of the relay cassette 10 and the fuse cassette 11, which are different in size from each other, can be attached to the outer side surface of the casing 1, using the corresponding casing-side fitting guide portions 4, 14. Therefore, the parts can be arranged in accordance with the arrangement of the electronic equipments which varies from one kind of car to another, and the common parts can be used, and also the degree of freedom of arrangement of the parts can be enhanced.

The cassette-side fitting guide portions 15 for being guided by the casing-side fitting guide portions 4 are formed on the attaching-side portion of the relay cassette 10, and also the cassette-side fitting guide portions 18 for being guided by the casing-side fitting guide portions 14 are on the attaching-side portion of the fuse cassette 11. Therefore, the cassette is attached to the casing while guiding the cassette-side fitting guide portions 15 or 18 by the casing-side fitting guide portions 4 or 14, and therefore the attaching operation can be effected more positively and easily.

The electric connection box of the present invention is not limited to the above embodiment. For example, although the common cassette fitting portions 12 are formed on the outer side surfaces of the casing 1, these portions 12 can be formed on the inner surfaces of the casing. In this embodiment, although the relay cassettes 10 are attached to one of the opposite outer side surfaces of the casing while the fuse cassettes 11 are attached to the other outer side surface, the relay cassette 10 and the fuse cassette 11 can be alternately attached to the outer side surface.

In another embodiment shown in FIG. 9, the relay cassette fitting portions 2 are formed on one outer side surface of the casing, and the common cassette fitting portions 12 are formed on the other outer side surface. With this construction, the relay cassettes 10 are attached to the one outer side surface while either of the relay cassette 10 and the fuse cassette 11 can be attached to each common cassette fitting portion 12 on the other outer side surface.

As described above, in the electric connection box of the present invention, each of the cassette fitting portions includes the plurality of pairs of casing-side fitting guide portions which are formed in a projected manner on the outer side surface of the casing, and respectively guide the attaching-side portions of the corresponding cassettes in the upward and downward directions, and the casing-side retaining portion which is common to the cassettes, and is formed midway between each pair of casing-side fitting guide portions so as to be engaged with the cassette-side retaining portions formed respectively on one side surfaces of the cassettes. The distance between each pair of casing-side fitting guide portions corresponds to the width of the corresponding cassette.

Therefore, any one of different kinds of cassettes, which are different in size from each other, can be attached to the outer side surface of the casing, using the corresponding casing-side fitting guide portions. Therefore, the parts can be arranged in accordance with the arrangement of the electronic equipments which varies from one kind of car to another, and the common parts can be used, and also the degree of freedom of arrangement of the parts can be enhanced.

In the above electric connection box, the cassette-side fitting guide portions for being guided by the corresponding casing-side fitting guide portions on the casing are formed on the attaching-side portion of the cassette, and therefore, the cassette is attached to the casing while guiding the cassette-side fitting guide portions by the casing-side fitting guide portions, and therefore the attaching operation can be effected more positively and easily.

What is claimed is:

1. An electric connection box, comprising:

a casing including at least one casing-side retaining portion;

at least one cassette attachable to the casing, said at least one cassette including an attaching-side portion having a cassette-side retaining portion; and at least two pairs of casing-side fitting guide portions formed in a projected manner on a side surface of the casing, wherein, when said at least one cassette is attached to the casing, the attaching-side portion is guided by one of said at least two pairs of casing-side fitting guide portions, and the cassette-side retaining portion is engaged with said at least one casing-side retaining portion.

2. The electric connection box of claim 1, wherein the cassette-side retaining portion is formed on a side surface of said at least one cassette.

3. The electric connection box of claim 1, wherein said at least one casing-side retaining portion is formed midway between each pair of said at least two pairs of casing-side fitting guide portions.

4. The electric connection box of claim 1, further comprising a pair of cassette-side fitting guide portions formed on the attaching-side portion of said at least one cassette, the cassette-side fitting guide portions being guided by one of said at least two pairs of casing-side fitting guide portions when said at least one cassette is attached to the casing.

5. The electric connection box of claim 1, wherein, said at least one cassette further comprises a first pair of cassette-side fitting guide portions, the first pair of cassette-side fitting guide portions is guided by a first pair of said at least two pairs of casing-side fitting guide portions when said at least one cassette is attached to the casing.

6. The electric connection box of claim 5, wherein, said at least one cassette further comprises a second pair of cassette-side fitting guide portions, the second pair of cassette-side fitting guide portions is guided by a second pair of said at least two pairs of casing-side fitting guide portions when said at least one cassette is attached to the casing.

7. The electric connection box of claim 6, wherein a distance between the second pair of the casing-side fitting guide portions corresponds to a width of the second pair of the cassette-side fitting guide portions.

8. The electric connection box of claim 5, wherein a distance between the first pair of the casing-side fitting guide portions corresponds to a width of the first pair of the cassette-side fitting guide portions.

* * * * *